US010199724B2

(12) United States Patent
Saitou et al.

(10) Patent No.: US 10,199,724 B2
(45) Date of Patent: Feb. 5, 2019

(54) ANTENNA

(71) Applicants: Tyco Electronics Japan G.K., Kanagawa (JP); Denso Corporation, Aichi-ken (JP)

(72) Inventors: Tatsuo Saitou, Aichi-ken (JP); Tohru Yamamoto, Kanagawa (JP); Takeshi Akitaya, Kanagawa (JP)

(73) Assignees: Tyco Electronics Japan G.K., Kanagawa (JP); Denso Corporation, Aichi-ken (JP)

( * ) Notice: Subject to any disclaimer, the term of this patent is extended or adjusted under 35 U.S.C. 154(b) by 29 days.

(21) Appl. No.: 15/162,976

(22) Filed: May 24, 2016

(65) Prior Publication Data

US 2016/0352004 A1 Dec. 1, 2016

(30) Foreign Application Priority Data

May 25, 2015 (JP) ..... 2015-105805

(51) Int. Cl.

| | |
|---|---|
| ***H01Q 1/32*** | (2006.01) |
| ***H01Q 1/48*** | (2006.01) |
| ***H01Q 1/08*** | (2006.01) |
| *H01Q 5/371* | (2015.01) |

(52) U.S. Cl.
CPC ..... *H01Q 1/48* (2013.01); *H01Q 1/088* (2013.01); *H01Q 1/3291* (2013.01); *H01Q 5/371* (2015.01)

(58) Field of Classification Search
CPC ..... H01Q 1/088; H01Q 1/12; H01Q 1/1207; H01Q 1/1221; H01Q 1/20; H01Q 1/273; H01Q 1/276; H01Q 1/3291; H01Q 1/48; H01Q 1/32; H01Q 1/325; H01Q 1/3283
See application file for complete search history.

(56) References Cited

U.S. PATENT DOCUMENTS

| | | | | |
|---|---|---|---|---|
| 7,053,842 | B2 * | 5/2006 | Chen | H01Q 1/10 343/702 |
| 7,845,983 | B2 * | 12/2010 | Kawada | H01Q 1/1271 439/607.46 |
| 2005/0075004 | A1 | 4/2005 | Endou et al. | |
| 2011/0109509 | A1 | 5/2011 | Chou et al. | |

(Continued)

FOREIGN PATENT DOCUMENTS

| | | | |
|---|---|---|---|
| CN | 1604397 | A | 4/2005 |
| JP | 2004236184 | A | 8/2004 |
| JP | 2005223476 | A | 8/2005 |

(Continued)

OTHER PUBLICATIONS

Japanese Notification of Reasons for Refusal and English translation, dated Jul. 4, 2018, 4 pages.

(Continued)

*Primary Examiner* — Tho G Phan
*Assistant Examiner* — Patrick Holecek
(74) *Attorney, Agent, or Firm* — Barley Snyder

(57) ABSTRACT

An in-vehicle antenna is disclosed. The in-vehicle antenna is configured to be installed with an installation counterpart having a ground surface. The in-vehicle antenna has an element part, a ground part integrally connected to the element part, and a clamping part configured to clamp the installation counterpart together with the ground part with elastic force.

12 Claims, 7 Drawing Sheets

(56) References Cited

U.S. PATENT DOCUMENTS

2014/0159990 A1 6/2014 Azhari

FOREIGN PATENT DOCUMENTS

| | | | |
|---|---|---|---|
| JP | 200861204 | A | 3/2008 |
| JP | 20094208 | A | 1/2009 |
| JP | 4298766 | B2 | 4/2009 |
| JP | 20109428 | A | 1/2010 |
| JP | 2010226550 | A | 10/2010 |
| JP | 4780352 | B2 | 7/2011 |
| JP | 2013201511 | A | 10/2013 |

OTHER PUBLICATIONS

CN office action in co-pending application dated Jul. 27, 2018, 6 pages.
Translated CN office action issued in co-pending application dated Jul. 27, 2018, 7 pages.

* cited by examiner

ANTENNA

CROSS-REFERENCE TO RELATED APPLICATION

This application claims the benefit of the filing date under 35 U.S.C. § 119(a)-(d) of Japanese Patent Application No. 2015-105805, filed May 25, 2015.

FIELD OF THE INVENTION

The present invention relates to an antenna, and more particularly, to an antenna suitable to be mounted in a vehicle.

BACKGROUND

As is known in the prior art, an in-vehicle antenna may be installed as an element of a Bluetooth® module of a vehicle navigation apparatus. The in-vehicle antenna needs to be reliably fixed to an installation counterpart, such as a casing of a device, so that communication with Bluetooth®-enabled devices used within the vehicle can be maintained on a constant basis.

As described in JP2013-201511 A and JP2004-236184 A, a sheet metal antenna fabricated through sheet metal working of a metal plate is often used for this type of antenna in order to reduce costs. The antenna of this type is generally installed in a casing by screwing the sheet metal antenna onto the casing. However, since screwing involves a large number of steps, it is desirable to implement installation by a simpler method to reduce costs of the in-vehicle devices. The in-vehicle antenna is further required to stably maintain an installed state during vibration and impact caused by both operation of a vehicle engine and vehicle motion. The sheet metal antenna has a ground part which comes into contact with a ground part provided in the installation counterpart, and the mechanical contact and electrical connection between the ground parts needs to be stably maintained even when these vibrations and impacts are applied thereto.

SUMMARY

An object of the invention, among others, is to provide an antenna allowing easy installation and having a ground part capable of securing a contact state with a ground part of an installation counterpart even when vibration and impact are applied thereto. The disclosed in-vehicle antenna is configured to be installed with an installation counterpart having a ground surface. The in-vehicle antenna has an element part, a ground part integrally connected to the element part, and a clamping part configured to clamp the installation counterpart together with the ground part with elastic force.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an antenna. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
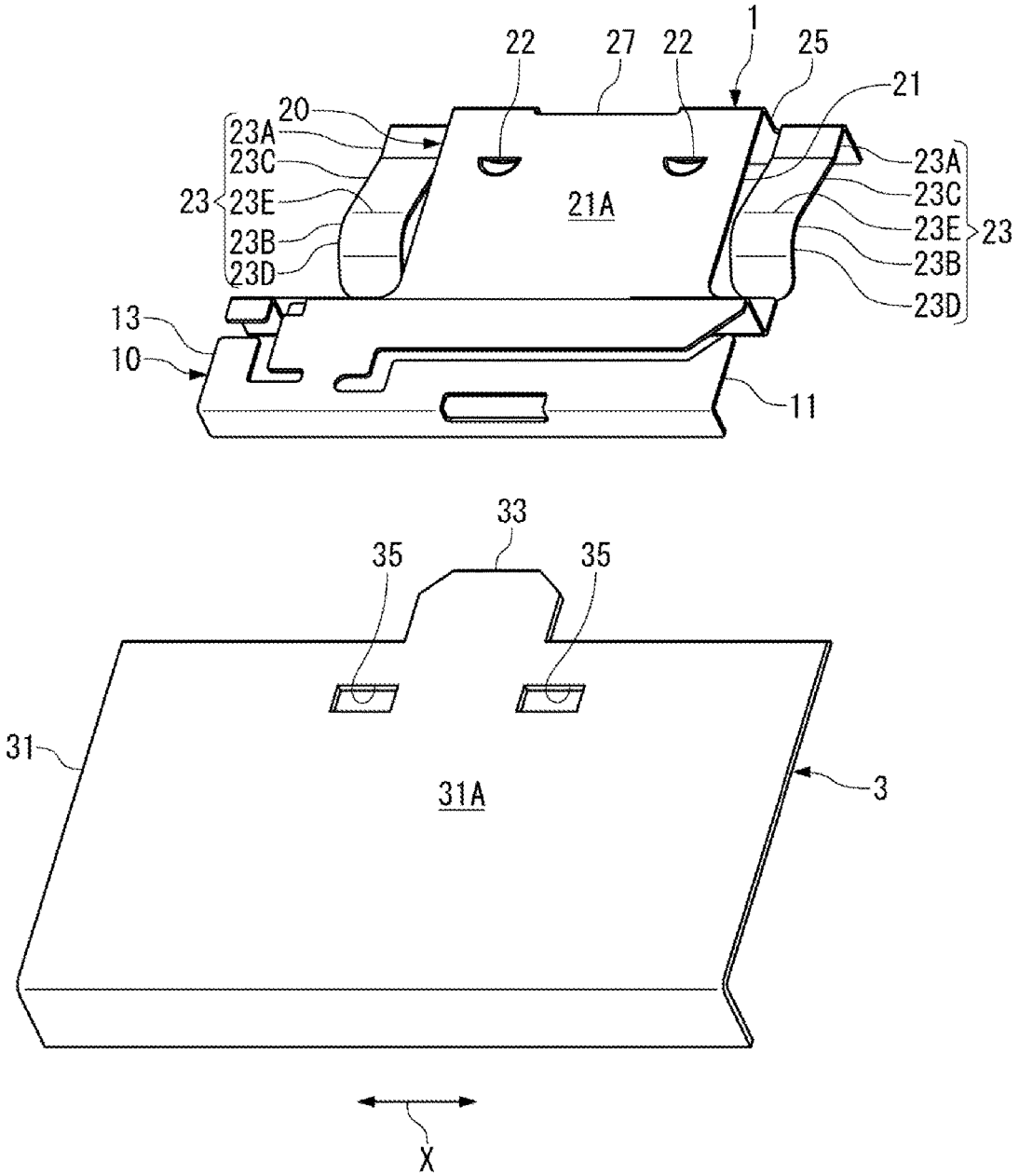
FIG. 1 is a front perspective view of an in-vehicle antenna and an installation counterpart according to the invention.
Figure 2:
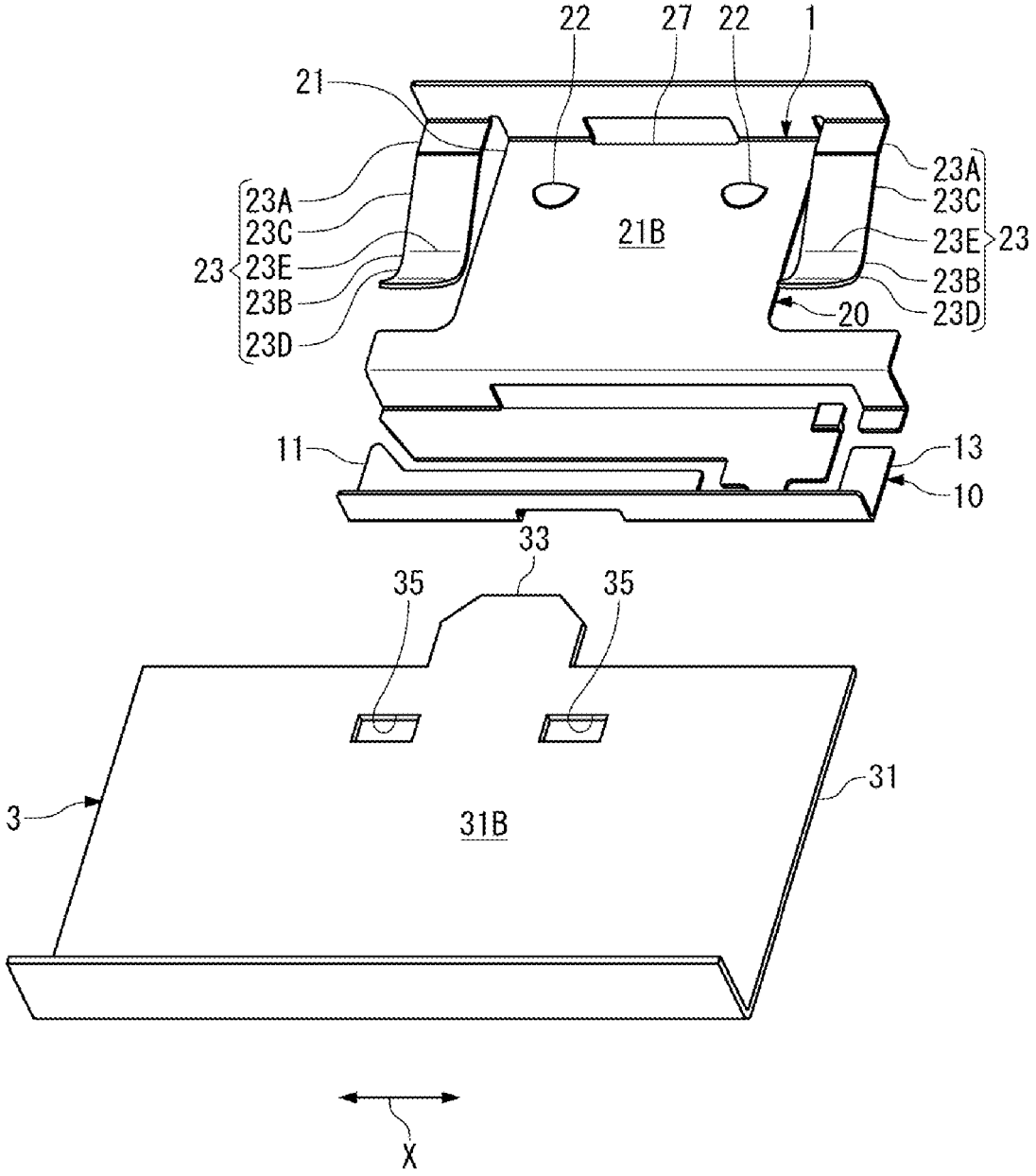
FIG. 2 is a back perspective view of the in-vehicle antenna and installation counterpart of FIG. 1.

An in-vehicle antenna 1 according to an embodiment of the present invention is generally shown in FIG. 1. The in-vehicle antenna 1 according to the present embodiment may be installed in an installation counterpart 3, such as a casing, which faces a slot of an instrument panel that houses a vehicle navigation apparatus. The installation counterpart 3, as shown in FIGS. 1 and 2, has a ground plate 31 with a front surface 31A and a back surface 31B, a guide projection 33, and a plurality of stopper mating elements 35.

The in-vehicle antenna 1 includes an element part 10 and a ground part 20. The element part 10 and ground part 20 may be integrally formed from a sheet metal. The in-vehicle antenna 1 may be made of a metal material excellent in conductivity and spring characteristics, such as phosphor bronze. Hereinafter, the major components of the in-vehicle antenna 1 will be described in more detail.

The element part 10 of the present embodiment includes two antenna elements 11 and 13 to support two frequency bands. However, this configuration is merely exemplary and does not limit the present invention.

The ground part 20 includes a ground plate 21 and a pair of spring pieces 23.

The ground plate 21, which is in a flat plate-like form, has a front surface 21A and a back surface 21B opposite to the front surface 21A. On the back surface 21B, as shown in FIG. 2, a pair of stopper projections 22 are provided at a specified interval in a width direction X, the pair of stopper projections being made by cutting and raising the ground plate 21.

Figure 3A:
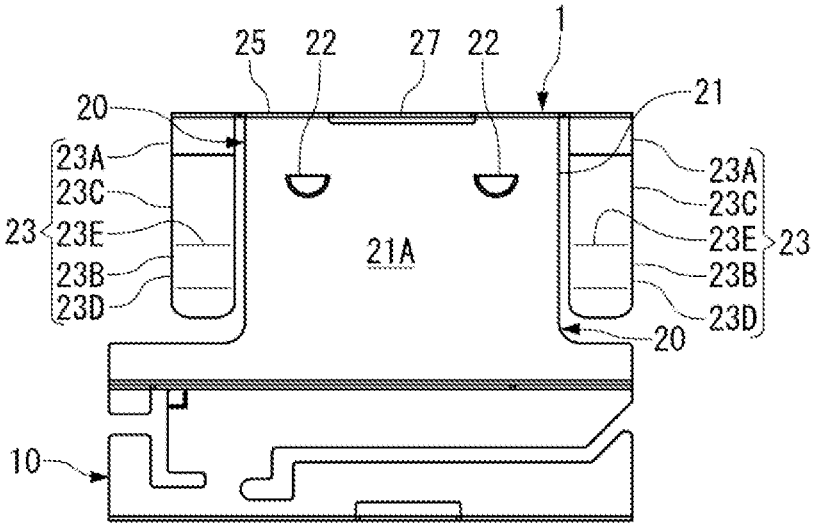
FIG. 3A is a plan view of the in-vehicle antenna of FIG. 1.

The spring pieces 23, which are linked with the ground plate 21 through a connection part (a coupling part) 25, are provided on both sides in the width direction X across the ground plate 21 provided at the center in the width direction X. A very small gap is provided between each of the spring pieces 23 and the ground plate 21 in the width direction X, as shown in FIG. 3A, so that the spring pieces 23 can deflect independently of the ground plate 21.

Each of the spring pieces 23 includes a fixed end part 23A connected to the connection part 25, and an elastic curved part 23B continued to the fixed end part 23A and extending toward the element part 10.

Figure 3B:
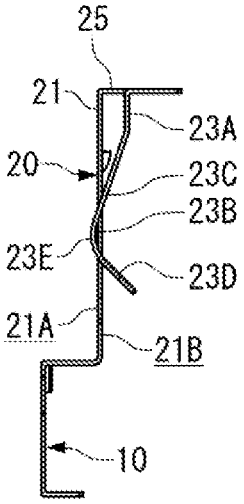
FIG. 3B is a side view of the in-vehicle antenna of FIG. 1.
Figure 3C:
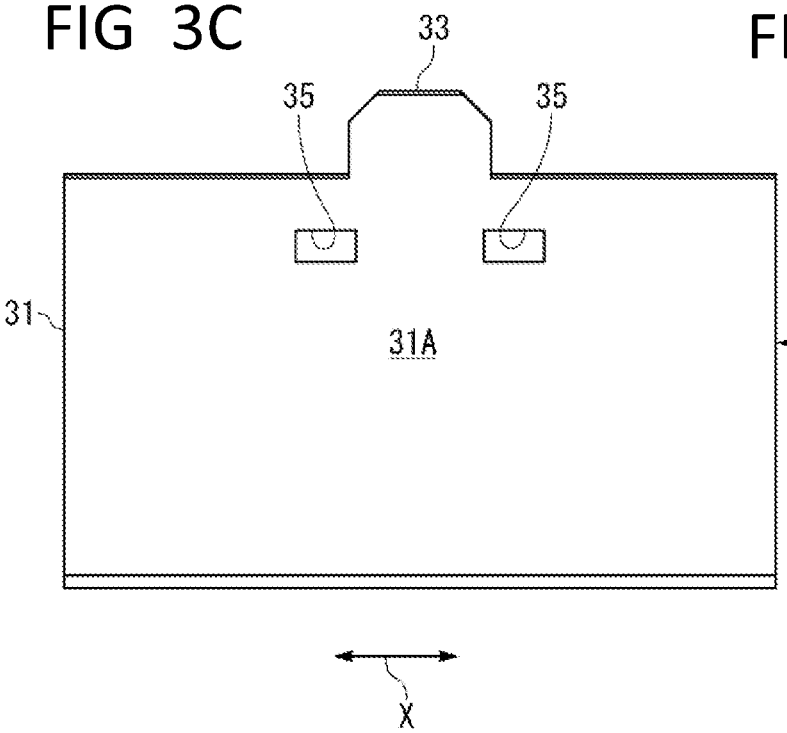
FIG. 3C is a plan view of the installation counterpart of FIG. 1.
Figure 3D:
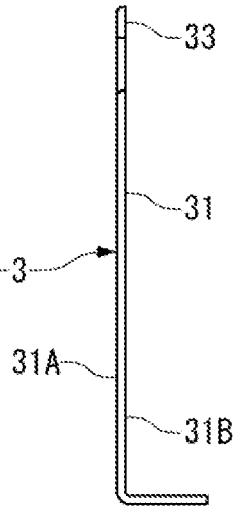
FIG. 3D is a side view of the installation counterpart of FIG. 1.

When the fixed end part 23A is viewed from the side, as illustrated in FIG. 3B, the fixed end part 23A is provided at a position retreated from the ground plate 21 toward the back surface 21B by a specified interval and is parallel to the ground plate 21. The interval between the fixed end part 23A and the ground plate 21 is set larger than a thickness of the ground plate 31 of the installation counterpart 3.

The elastic curved part 23B linked to the fixed end part 23A includes, as illustrated in FIG. 3B, an inclined part 23C rising from the back surface 21B side toward the front surface 21A side, and an inclined part 23D falling toward the back surface 21B side from a peak 23E. The elastic curved part 23B has generally an L-shaped longitudinal section. The inclined part 23D has a distal end extending in a direction away from the ground plate 21.

In each of the spring pieces 23, only the peak 23E and the vicinity thereof protrude to the front surface 21A side with the ground plate 21 as a boundary, and other parts are arranged on the back surface 21B side with the ground plate 21 as a boundary.

As illustrated in FIGS. 1-3D, the connection part 25, which is formed by being bent at right angle to the ground plate 21, links the ground plate 21 with the spring pieces 23 and 23. The connection part 25 is formed to be broader than the ground plate 21. The connection part 25 has parts protruding from both the sides of the ground plate 21 in the width direction X, and these protruding parts are linked to the spring pieces 23 and 23.

A guide recess 27 including a hole which penetrates the front surface and the back surface is formed over from the connection part 25 to the ground plate 21. The width of the guide recess 27 is set substantially identical to the width of the guide projection 33 of the installation counterpart 3.

Figure 4A:
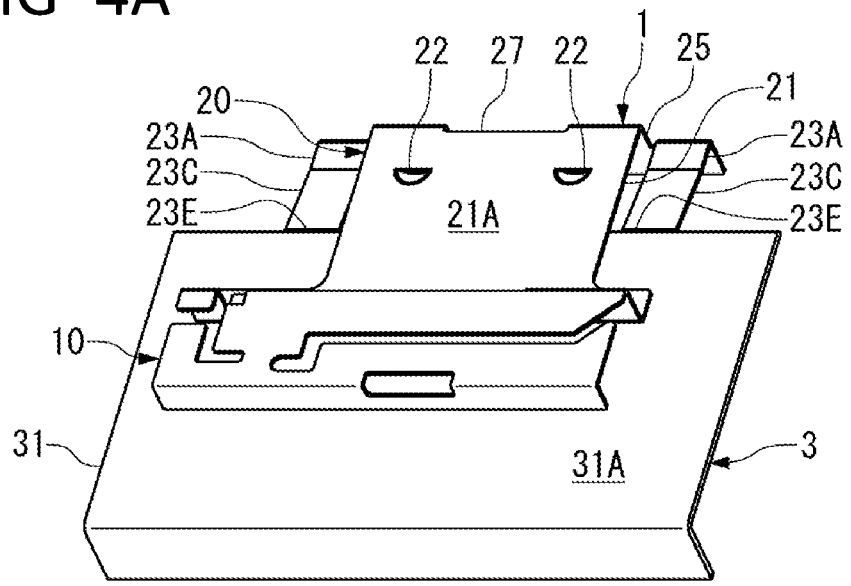
FIG. 4A is a front perspective view of the in-vehicle antenna and installation counterpart of FIG. 1 in an early stage of installation.

The installation of the in-vehicle antenna 1 in the installation counterpart 3 will now be described with reference for FIG. 4A and FIG. 7C.

First, the in-vehicle antenna 1 is placed with the element part 10 side facing the installation counterpart 3, and is positioned so that the ground plate 21, at back surface 21B, is in contact with and arranged on the front surface 31A side and the spring pieces 23 are arranged on the back surface 31B side with the installation counterpart 3 as a boundary. The obtained position is defined as an operation start position. An operator can perform the positioning operation and a series of installation work by holding the connection part 25.

Figure 4B:
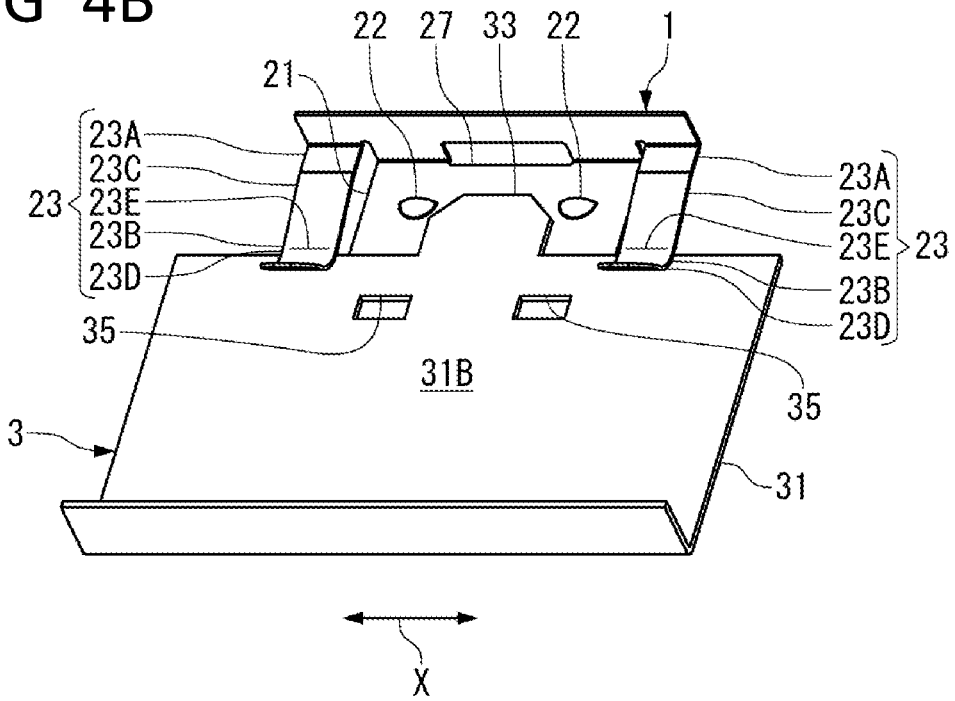
FIG. 4B is a back perspective view of the in-vehicle antenna and installation counterpart of FIG. 1 in an early stage of installation.
Figure 7A:
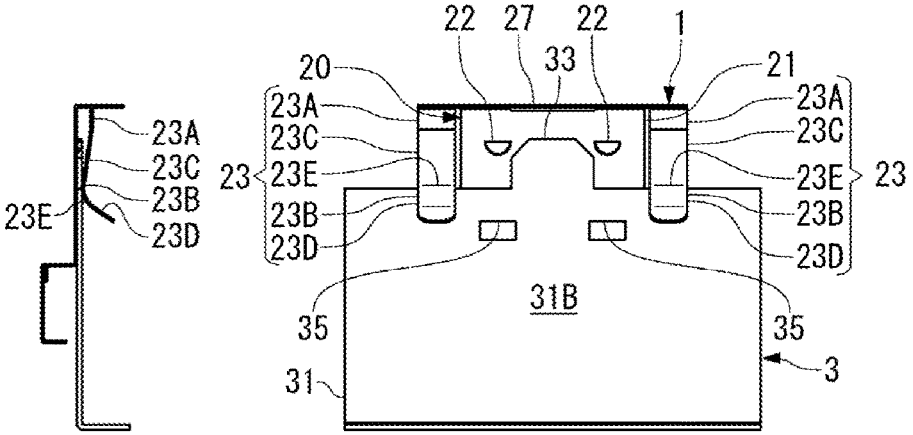
FIG. 7A is a side view and a plan view of the early stage of installation shown in FIGS. 4A and 4B.

Next, the in-vehicle antenna 1 at the operation start position is pushed toward the ground plate 31 of the installation counterpart 3 so that the ground plate 31 is clamped between the ground plate 21 and the inclined parts 23D of the spring pieces 23. Consequently, as illustrated in FIGS. 4A, 4B and 7A, the element part 10 and the ground plate 21 are arranged on the front surface 31A side of the ground plate 31, and the spring pieces 23 are arranged on the back surface 31B side of the ground plate 31, so that the installation counterpart 3 is clamped by the ground plate 21 and the spring pieces 23. The spring pieces 23 deflect so that inclination becomes smaller than that in a no-load state, and thereby generate elastic force. The generated elastic force is applied to the ground plate 31 from the peaks 23E which are in contact with the back surface 31B of the ground plate 31. In this early stage of installation, the guide recess 27 and the guide projection 33 are still separated.

Figure 5A:
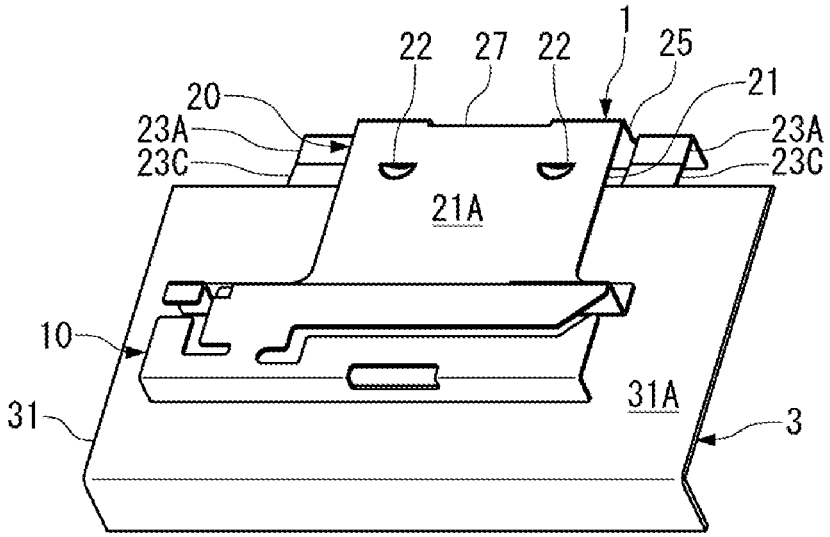
FIG. 5A is a front perspective view of the in-vehicle antenna and installation counterpart of FIG. 1 in a middle stage of installation.
Figure 5B:
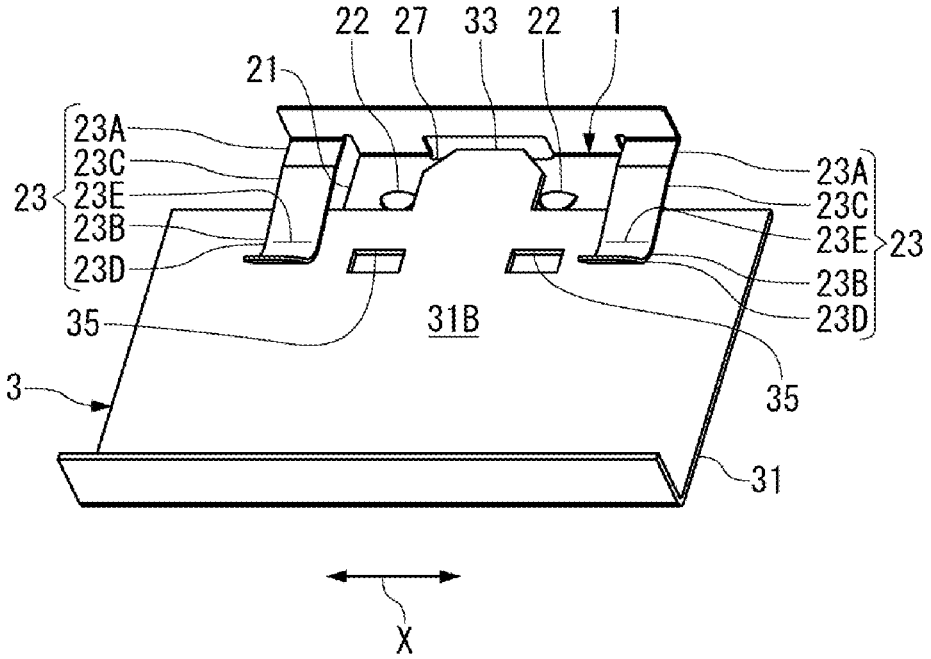
FIG. 5B is a back perspective view of the in-vehicle antenna and installation counterpart of FIG. 1 in a middle stage of installation.
Figure 7B:
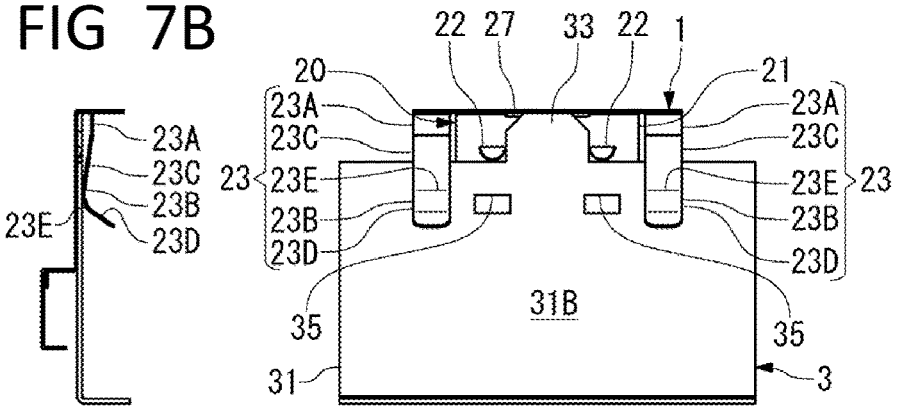
FIG. 7B is a side view and a plan view of the middle stage of installation shown in FIGS. 5A and 5B.

The in-vehicle antenna 1 is then further pushed in. At this time, the in-vehicle antenna 1 is pushed in while being positioned so that the guide projection 33 is inserted into the guide recess 27. FIGS. 5A and 5B illustrate the state immediately before the guide projection 33 is inserted into the guide recess 27. In this state, as illustrated in FIG. 7B, the stopper projections 22 of the ground plate 21 abut on an upper end edge of the ground plate 31. When the in-vehicle antenna 1 is further pushed in, the guide projection 33 with two chamfered corners is inserted into the guide recess 27, and the stopper projections 22 run on the front surface 31A of the ground plate 31.

Figure 6A:
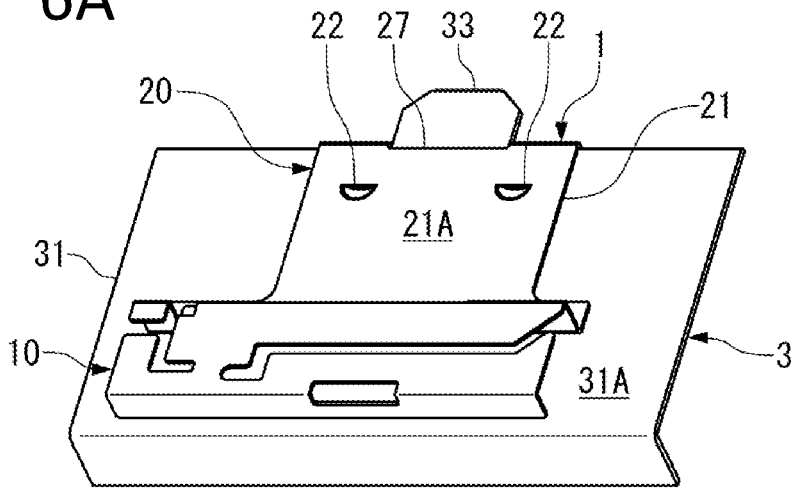
FIG. 6A is a front perspective view of the in-vehicle antenna and installation counterpart of FIG. 1 in an installed state.
Figure 6B:
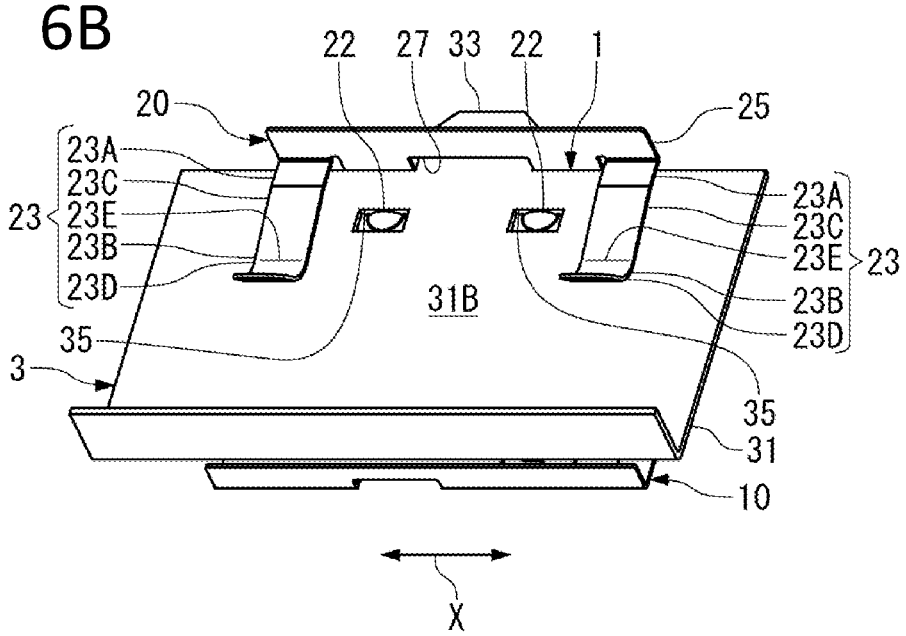
FIG. 6B is a back perspective view of the in-vehicle antenna and installation counterpart of FIG. 1 in an installed state.

The in-vehicle antenna 1 is further pushed in, but the in-vehicle antenna 1 is not displaced as it is guided by the guide projection 33. As illustrated in FIGS. 6A, 6B and 7C, the installation of the in-vehicle antenna 1 is completed when sheared upper edges of the stopper projections 22 of the ground plate 21 engage with and are inserted into upper edges of the stopper mating elements 35 of the ground plate 31, that is, when the in-vehicle antenna 1 is pushed into the backend of the installation counterpart 3. The guide projection 33 passes through the guide recess 27 of the connection part 25, and the upper end edge of the ground plate 31 of the installation counterpart 3 in the drawings abuts on the connection part 25.

Figure 7C:
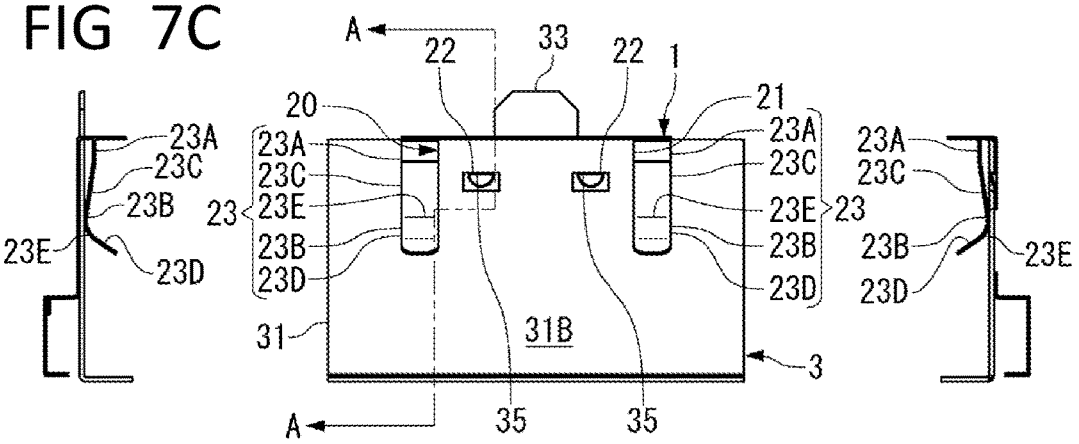
FIG. 7C is a side view, a plan view, and a sectional view taken along line A-A of the installed state shown in FIGS. 6A and 6B.

When the in-vehicle antenna 1 is in the state of being installed in the installation counterpart 3, the ground plate 21 is arranged on the front surface 31A side of the ground plate 31 as illustrated in FIGS. 6A, 6B and 7C, while the spring pieces 23 are arranged on the back surface 31B side of the ground plate 31. Thus, the ground plate 21 and the spring pieces 23 function like a clip to clamp the ground plate 31 with elastic force, so that the in-vehicle antenna 1 is installed in the installation counterpart 3. In this installed state, the stopper projections 22 and 22 inserted into stopper mating elements 35 of the ground plate 31 prevent the in-vehicle antenna 1 from slipping off from the installation counterpart 3.

The in-vehicle antenna 1 described in the foregoing produces the following effects.

First, the installation work of the in-vehicle antenna 1 can be performed just by pushing the ground plate 21 and the spring pieces 23 into the ground plate 31 like a clip. Therefore, the in-vehicle antenna 1 simplifies the work of installation in the installation counterpart 3.

Since the spring pieces 23 have the elastic curved parts 23B, and their inclined parts 23D have distal ends extending in the direction away from the ground plate 21, a large interval is present between the ground plate 21 and the distal end parts of the inclined parts 23D. That is, since the in-vehicle antenna 1 easily receives the installation counterpart 3, the ground plate 31 can be easily clamped. Since the peaks 23E of the elastic curved parts 23B come into contact with the ground plate 31 and apply elastic force thereto, the spring pieces 23 produce elastic force stronger than the case of spring pieces having the same overall length, in which the distal ends (free ends) come into contact with the ground plate 31. Thus, providing the elastic curved parts 23B makes it possible to enhance the workability and to strengthen the force to clamp the ground plate 31.

During the installation work, the in-vehicle antenna 1 can be pushed into the installation counterpart 3 while the guide projection 33 of the ground plate 31 is invited into the guide recess 27 of the ground plate 21. Therefore, the installation work can be performed without the in-vehicle antenna 1 being displaced.

Furthermore, in the in-vehicle antenna 1, the connection part 25 which links the spring pieces 23 with the ground plate 21 is bent toward the ground plate 21. The operator who installs the in-vehicle antenna 1 in the installation counterpart 3 can push the in-vehicle antenna 1 into the installation counterpart 3 by holding the connection part 25. Since the connection part 25 is at the position closest to the operator as viewed in a pushing direction, good workability is ensured.

Next, since the ground plate 31 is clamped by the ground plate 21 and a pair of the spring pieces 23 after the in-vehicle antenna 1 is installed in the installation counterpart 3, ground connection by surface contact between the ground plate 21 and the ground plate 31 can be achieved. In particular, since a pair of the spring pieces 23 clamp the ground plate 31 on both sides in the width direction X, the ground contact can be maintained stable even when vibration and impact are applied.

Moreover, after the in-vehicle antenna 1 is installed in the installation counterpart 3, the stopper projections 22 of the ground plate 21 engage with the stopper mating elements 35 of the ground plate 31. This prevents the in-vehicle antenna 1 from slipping off from the installation counterpart 3. Since the present embodiment adopts the configuration in which two stopper projections 22 provided at an interval in the width direction X engage with the stopper 35 in particular, it becomes possible to more reliably prevent the in-vehicle antenna 1 from slipping off from the installation counterpart 3.

In the in-vehicle antenna 1, the ground plate 31 is clamped between the ground plate 21 and the spring pieces 23. Since an interval is provided between the fixed end parts 23A of the spring piece 23 and the ground plate 21 so that the ground plate 31 can be inserted therein, the ground plate 31 can be inserted into the backend of the ground plate 21 and the spring piece 23. As a result, it becomes possible to secure a wide contact area between the ground plate 21 and the ground plate 31. It also becomes possible to make the area of a plate material used for fabricating the in-vehicle antenna 1 relatively small.

In the usage of the in-vehicle antenna 1, the element part 10 receives radio waves emitted from a communication terminal within a communication distance, and the received radio waves are transmitted as electric signals to a wireless communication circuit in a wireless communication module. The electrical signals generated in the wireless communication circuit are transmitted to the element part 10 through a feed line which is not illustrated, and are emitted as radio waves toward a communication terminal within a communication distance. The ground part 20 connected to the ground plate 31 obtains a reference potential. Although the present embodiment has been described with the in-vehicle antenna 1 as an example, the present invention is widely applicable to antennas other than the in-vehicle antenna.

Although an embodiment of the present invention has been described in the foregoing, the configurational aspects disclosed in the embodiment can be selected and changed to other configuration aspects without departing from the scope of the present invention.

Although the in-vehicle antenna 1 of the present embodiment includes a pair of the spring pieces 23 on both the sides in the width direction X across the ground plate 21, the spring pieces may be provided so as to face the ground plate 21.

Although a pair of the stopper projections 22 are provided in the ground plate 21 for stopping slipping-off from the installation counterpart 3 in the present embodiment, the number and position of the stopper projections are arbitrarily set as long as the purpose of stopping slipping-off from the installation counterpart 3 is achieved. Furthermore, although the stopper projections 22 are provided in the ground plate 21 and the stopper mating elements 35 are provided in the ground plate 31 in the present embodiment, they may reversely be provided, that is, the stopper mating elements are provided in the ground plate 21, and the stopper projections are provided in the ground plate 31. Although the stopper mating elements 35 penetrate the front surface and the back surface of the ground plate 31, they may be recesses instead of the holes.

Although the guide projection 33 is provided in the installation counterpart 3 and the guide recess 27 is provided in the in-vehicle antenna 1 as the guide means in the present embodiment, the guide recess may be provided in the installation counterpart 3, and the guide projection may be provided in the in-vehicle antenna 1. Without being limited to this configuration, the guide means may include, for example, a projection extending in a direction of pushing the in-vehicle antenna 1, and a groove in which the projection is fit.

Furthermore, the present embodiment is characterized by the ground part 20 which is configured to clamp the ground plate 31. As long as this characteristic is implemented, the element part 10 and the ground part 20 can take any form.

What is claimed is:

1. An in-vehicle antenna assembly, comprising:

a casing of device having a flat ground surface and a flat guide projection located along an edge of the casing of device, the flat guide projection extending outward along the edge of the casing of device; and an in-vehicle antenna having an element part, a ground part, a clamping part, and a guide recess integrally formed from a metal sheet, the guide recess formed to receive the guide projection of the casing of device, and the clamping part configured to clamp the casing of device together with the ground part with elastic force.

2. The in-vehicle antenna assembly of claim 1, wherein a front surface of the ground part is in mechanical contact and electrical connection with the ground surface.

3. The in-vehicle antenna assembly of claim 2, wherein the front surface of the ground part has a plurality of stopper projections.

4. The in-vehicle antenna assembly of claim 3, wherein a pair of stopper projections are disposed on the front surface at an interval in the width direction.

5. The in-vehicle antenna assembly of claim 3, wherein the ground surface has a plurality of stopper mating elements.

6. The in-vehicle antenna assembly of claim 5, wherein the plurality of stopper projections are engaged with the plurality of stopper mating elements to prevent the in-vehicle antenna from slipping off the casing of device.

7. The in-vehicle antenna assembly of claim 6, wherein the in-vehicle antenna has a coupling part connecting the ground part to the clamping part.

8. The in-vehicle antenna assembly of claim 7, wherein the guide projection is inserted into the guide recess.

9. The in-vehicle antenna assembly of claim 1, wherein the clamping part includes a pair of spring pieces.

10. The in-vehicle antenna assembly of claim 9, wherein the ground part is disposed between the pair of spring pieces in a width direction.

11. The in-vehicle antenna assembly of claim 10, wherein each spring piece is curved and has a peak.

12. The in-vehicle antenna assembly of claim 11, wherein the peak of each spring piece is in contact with the casing of device.

* * * * *